US011832702B2

(12) United States Patent
Paquin

(10) Patent No.: US 11,832,702 B2
(45) Date of Patent: Dec. 5, 2023

(54) SELECTIVELY REMOVABLE AND PROTECTIVE NAIL COVER KIT

(71) Applicant: Tara Paquin, Boca Raton, FL (US)

(72) Inventor: Tara Paquin, Boca Raton, FL (US)

( * ) Notice: Subject to any disclaimer, the term of this patent is extended or adjusted under 35 U.S.C. 154(b) by 214 days.

(21) Appl. No.: 17/232,990

(22) Filed: Apr. 16, 2021

(65) Prior Publication Data

US 2022/0330678 A1 Oct. 20, 2022

(51) Int. Cl.
*A45D 29/00* (2006.01)

(52) U.S. Cl.
CPC ..... *A45D 29/00* (2013.01); *A45D 2029/008* (2013.01); *A45D 2200/25* (2013.01)

(58) Field of Classification Search
CPC ..... A45D 29/00; A45D 2029/008; A45D 2200/25; A45D 31/00; A45D 29/22; G06F 2203/0331; G06F 3/03545; A41D 13/087
See application file for complete search history.

(56) References Cited

U.S. PATENT DOCUMENTS 3,967,631 A * 7/1976 Kosal ..... A41D 13/087 132/73
4,408,622 A * 10/1983 Meyerhoefer ..... A45D 31/00 132/73
4,665,934 A * 5/1987 Jefferson ..... A45D 34/00 132/320
4,694,843 A * 9/1987 Casenhiser ..... A45D 29/00 2/21
4,960,138 A * 10/1990 Kling ..... A45D 29/00 132/73
8,970,559 B1 * 3/2015 McVickar ..... G06F 3/03545 345/179
2012/0210486 A1 * 8/2012 McJunkin ..... G10D 3/00 2/69
2013/0014308 A1 * 1/2013 Feliciano ..... A41D 13/087 2/21
2013/0076690 A1 * 3/2013 Vellanki ..... G06F 3/0393 345/174
2014/0007894 A1 * 1/2014 Gagnon ..... A45D 29/00 132/200
2015/0013709 A1 * 1/2015 Scheurn ..... A45D 29/18 132/73
2019/0200723 A1 * 7/2019 Atlas ..... G06F 3/0488

OTHER PUBLICATIONS

Chris Chon, Stunning Press on Nails that Look Amazing, The Nailest Custom Nail Bar, https://thenailest.com/blogs/news/ stunning-press-on-nails-that-look-amazing (2019) (Year: 2019).*

* cited by examiner

*Primary Examiner* — Nicholas D Lucchesi
(74) *Attorney, Agent, or Firm* — Mark C. Johnson; Johnson Dalal

(57) ABSTRACT

A selectively removable and protective nail cover kit that includes one or more elastically deformable and unitary bodies each having a sidewall with an outer surface, with a first end enclosing and defining a lower aperture, with a second end opposing the first end of the sidewall, defining a body length separating the first and second ends of the sidewall, of a practical sidewall thickness spanning the body length, and with an inner surface defining a nail placement cavity that is enclosed by the sidewall and preformed into an arcuate shape, spans from the lower aperture and terminating at an upper internal wall of the elastically deformable and unitary body that is disposed proximal to the second end of the sidewall, and of a length less than 2 inches.

20 Claims, 8 Drawing Sheets

SELECTIVELY REMOVABLE AND PROTECTIVE NAIL COVER KIT

FIELD OF THE INVENTION

The present invention relates generally to nail covers, and, more particularly, relates to polymeric selectively removable covers to protect a person's nails.

BACKGROUND OF THE INVENTION

A nail is a claw-like keratinous plate at the tip of the fingers and toes in most primates. Fingernails and toenails are made of a tough protective protein called alpha-keratin which is a polymer and found in the hooves, hair, claws and horns of vertebrates. Many users spend significant amounts of time and money caring for, maintaining, and/or decorating their nails. To that end, many users are looking for ways to prolong the health, integrity, and design of their nails.

Some known methods of prolonging the health, integrity, and/or design of a user's nails include applying a liquid based coating, e.g., epoxy, over the top surface of the user's nails. These coatings, however, are generally susceptible to failure (e.g., chipping or removal) days, or in some instances, hours, after application. These coatings also fail to prevent damage to a user's nails when subjected to harsher impacts.

Therefore, a need exists to overcome the problems with the prior art as discussed above.

SUMMARY OF THE INVENTION

The invention provides a selectively removable and protective nail cover that overcomes the hereinafore-mentioned disadvantages of the heretofore-known devices and methods of this general type and that effectively protects a user's nails, including any polish or design thereon in an effective and efficient manner.

With the foregoing and other objects in view, there is provided, in accordance with the invention, a selectively removable and protective nail cover kit that includes an elastically deformable and unitary body having a sidewall with an outer surface, with a first end enclosing and defining a lower aperture, with a second end opposing the first end of the sidewall, defining a body length separating the first and second ends of the sidewall, of a sidewall thickness within a range of 0.1-1.0 inches spanning the body length, and with an inner surface defining a nail placement cavity. The nail placement cavity is enclosed by the sidewall and preformed into an arcuate shape, spans from the lower aperture and terminating at an upper internal wall of the elastically deformable and unitary body that is disposed proximal to the second end of the sidewall, and is of a length less than 2 inches.

In accordance with a further feature of the present invention, the body length is within a range of 0.25 inches to 0.55 inches.

In accordance with another feature, an embodiment of the present invention includes a set of ten elastically deformable and unitary bodies consisting of five pairs each respectively having equal body length dimensions.

In accordance with an additional feature of the present invention, at least four of the five pairs each respectively having unique body length dimensions. Further, at least four of the five pairs may each increase in length with respect to one another. Further, the unique body length dimensions of the at least four of the five pairs may each respectively have a body length within a range of 0.25 inches to 0.55 inches.

In accordance with a further feature of the present invention, the outer surface of the sidewall is preformed into an arcuate shape.

In accordance with yet another feature of the present invention, the nail placement cavity tapers in thickness separating the inner surface of the sidewall from the lower aperture to the upper internal wall of the elastically deformable and unitary body.

In accordance with another feature of the present invention, the nail placement cavity uniformly tapers in thickness separating the inner surface of the sidewall from the lower aperture to the upper internal wall of the elastically deformable and unitary body.

In accordance with yet another feature of the present invention, the elastically deformable and unitary body is of a transparent material.

Although the invention is illustrated and described herein as embodied in a selectively removable and protective nail cover kit, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time. Also, for purposes of description herein, the terms "upper", "lower", "left," "rear," "right," "front," "vertical," "horizontal," and derivatives thereof relate to the invention as oriented in the figures and is not to be construed as limiting any feature to be a particular orientation, as said orientation may be changed based on the user's perspective of the device. Furthermore, there is no intention to be bound by any expressed or implied theory presented in the preceding technical field, background, brief summary or the following detailed description.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the elastic body, e.g., to and from the first and second ends of the sidewall of the elastic body.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
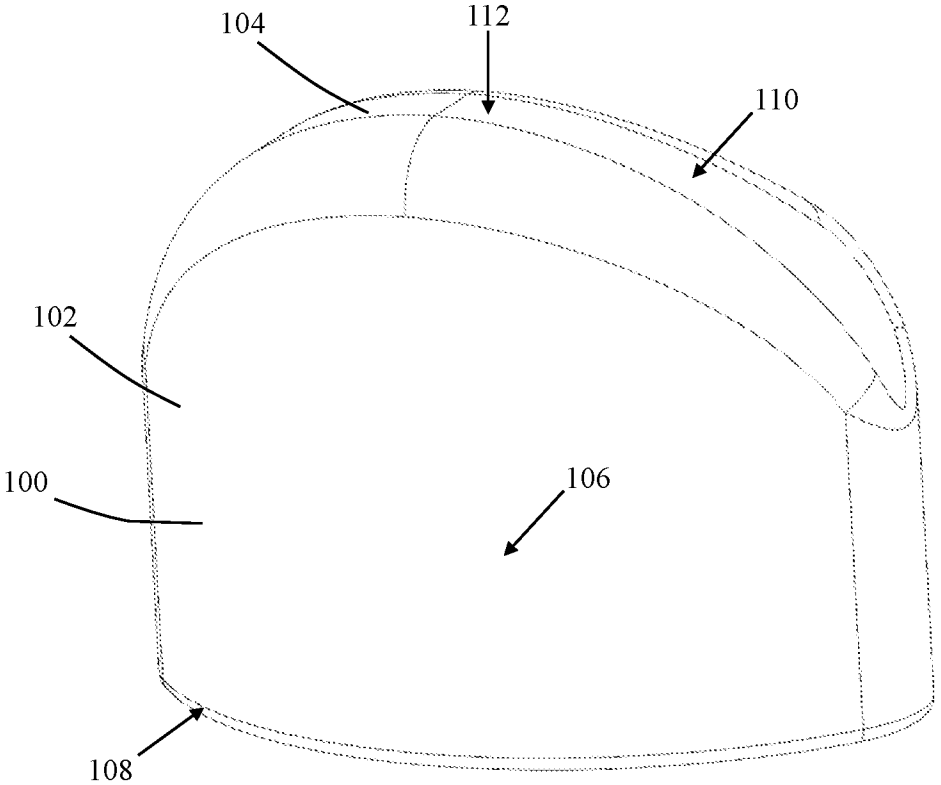
FIG. 1 is a perspective view of an elastically deformable body utilized with the selectively removable and protective nail cover kit in accordance with one embodiment of the present invention.
Figure 2:
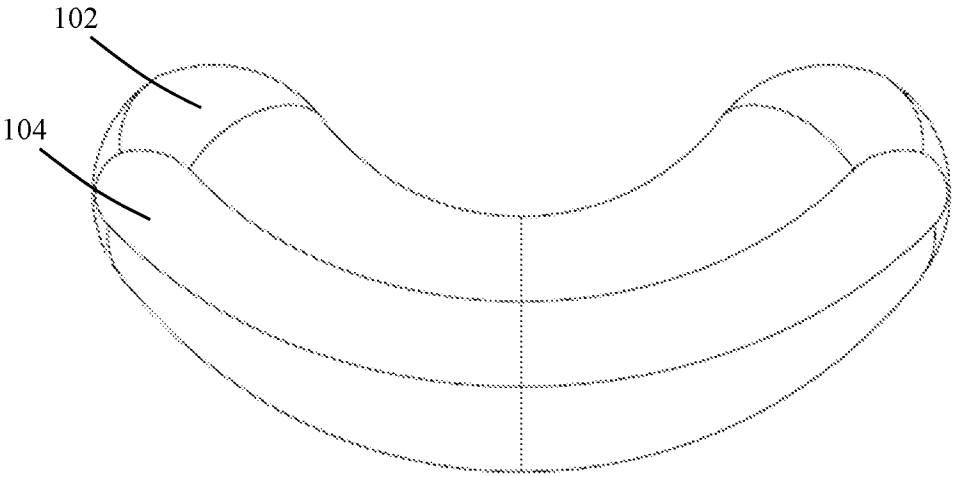
FIG. 2 is a top plan view of the elastically deformable body in FIG. 1.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient selectively removable and protective nail cover kit that solves the above-described problems known in the prior art and shields, protects, and adorns a user's nail(s) in an effective and efficient manner.

Figure 11:
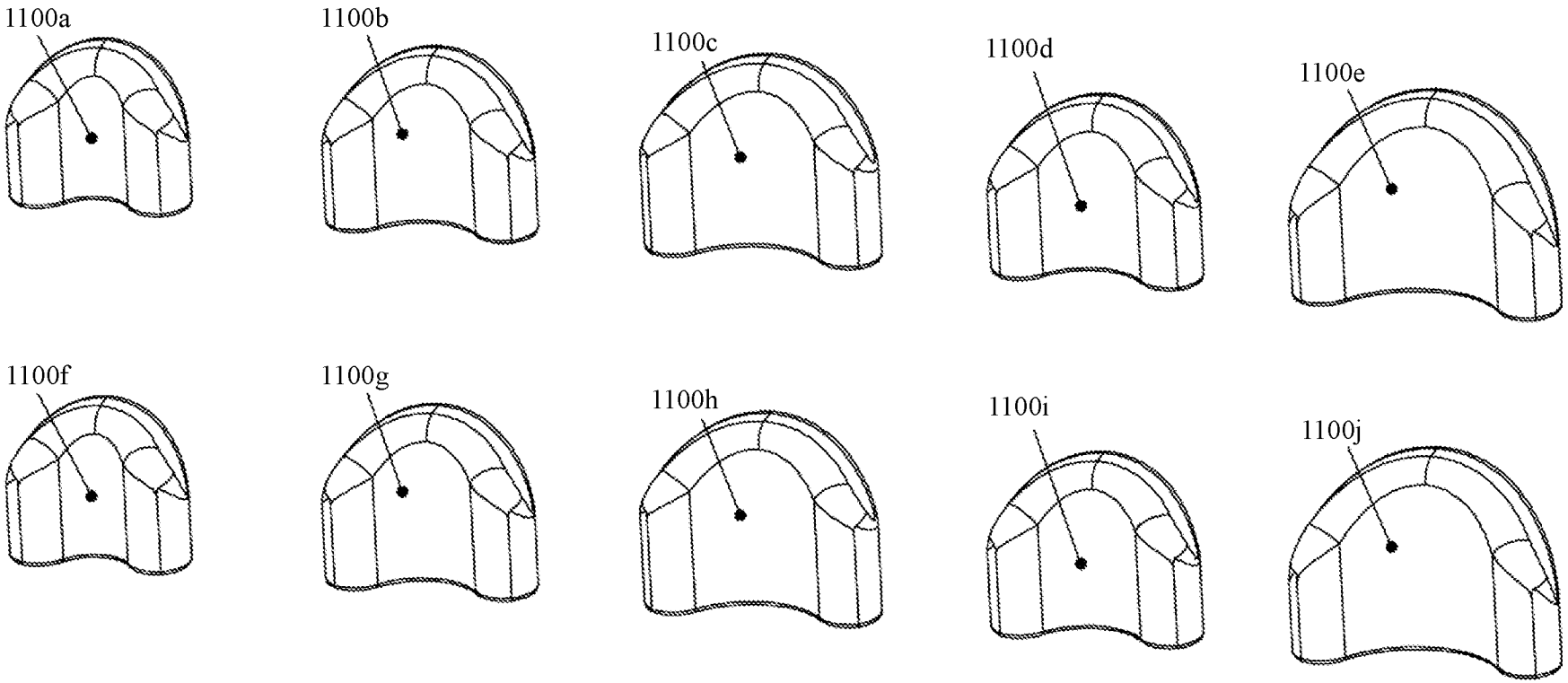
FIG. 11 is a perspective view of a selectively removable and protective nail cover kit in accordance with one embodiment of the present invention.

Referring now to FIG. 1 and FIG. 11, one embodiment of the present invention is shown in a perspective view. The figures show several advantageous features of the present invention, but, as will be described below, the invention can be provided in several shapes, sizes, combinations of features and components, and varying numbers and functions of the components. The first example of a selectively removable and protective nail cover kit, as shown in FIG. 1 and FIG. 11, includes an elastically deformable and unitary body 100 having a sidewall 102 with an outer surface 106, with a first end 108 and with a second end 112 opposing the first end 108 of the sidewall 102. In some embodiments, the first and second ends 108, 112 are the terminal ends of the body 100. The elastically deformable and unitary body 100 is preferably of a polymeric material, such as silicone rubber, but may be of another elastically deformable material such as neoprene. The body 100 is unitary in that it operates and is used as a single piece. As such, the body 100 may be injected molded, cast, or otherwise formed from multiple pieces (e.g., laser or heat welding) to form a unitary piece of material. The outer surface 106 is preferably smooth to the touch and of transparent material to effectuate display of the underlying nail surface in which it covers. To that end, it may be completely transparent or translucent, yet fall under the purview of being transparent unless otherwise indicated.

Figure 10:
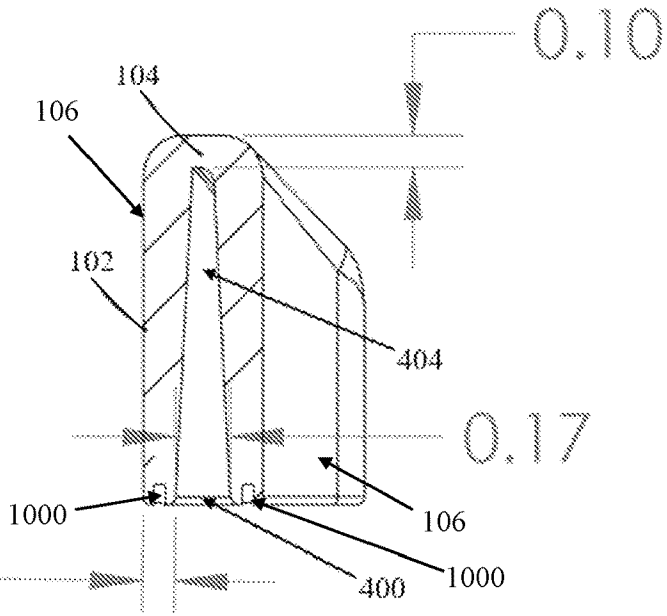
FIG. 10 is a cross-sectional view of an elastically deformable body along section line 8-8 in FIG. 8 with exemplary dimensions in accordance with one embodiment of the present invention.
Figure 9:
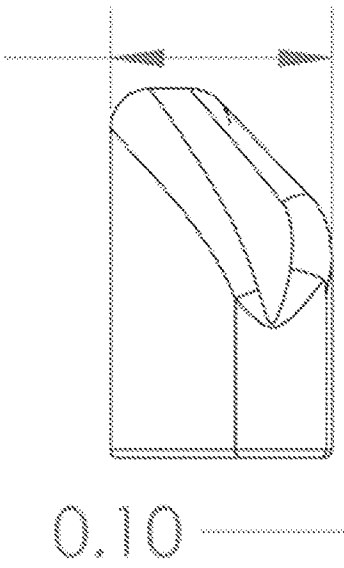
FIG. 9 is an elevational side view of an elastically deformable body with exemplary dimensions in accordance with one embodiment of the present invention.

As seen best in FIG. 1 and FIG. 10, the outer surface 106 can be seen forming an arcuate shape that beneficially enables functionality of a user's nail(s) and reduces the likelihood of the nail becoming damaged. The outer surface 106 may have portions on the front and rear sides of the body 100 that are substantially planar as they extend longitudinally up toward the second end 112 which is preferably of a convex and/or arcuate shape. The second end 112 may define, in certain embodiments, an upper aperture 110 that allows the tip of the user's nail to protrude therethrough. The upper aperture 110 may span substantially and continuously from the left and right side of the body 100 and beneficially enables functional control of the tip(s) of the user's nail(s), while protecting the front and rear of the user's nail(s). In other embodiments, like shown best in FIG. 10, the second end 112 does not define any openings and is a wall formed with merging portions of the sidewall 102. Therefore, the only access to a nail placement cavity 404 in said embodiment would be a lower aperture 400 defined and enclosed by the first end 108 of the sidewall 102. As used herein, the term "wall" is intended broadly to encompass continuous structures, as well as separate structures that are coupled together so as to form a substantially continuous external surface. In some embodiments, the second end 112 may also be described as being rounded and/or having the sidewall 102 merge together to form a point.

Figure 3:
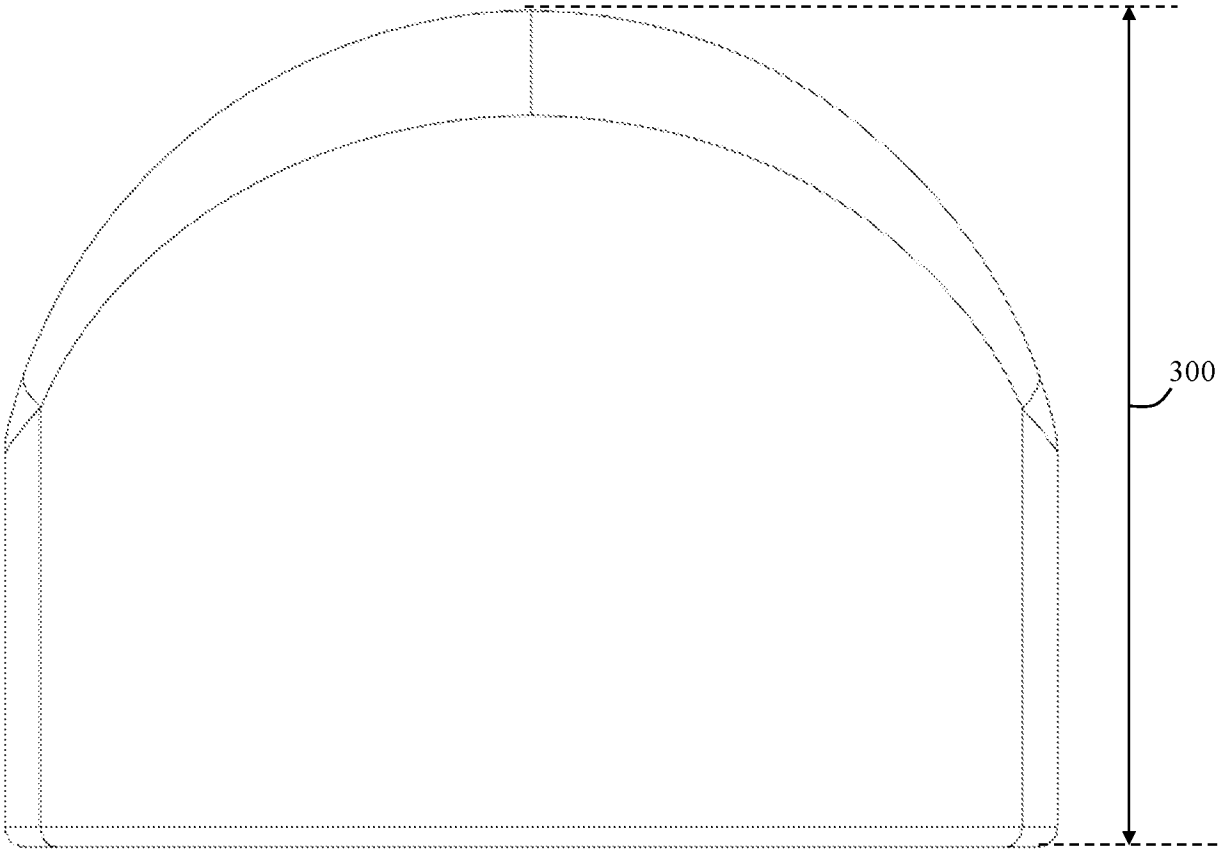
FIG. 3 is an elevational front view of the elastically deformable body in FIG. 1.
Figure 7:
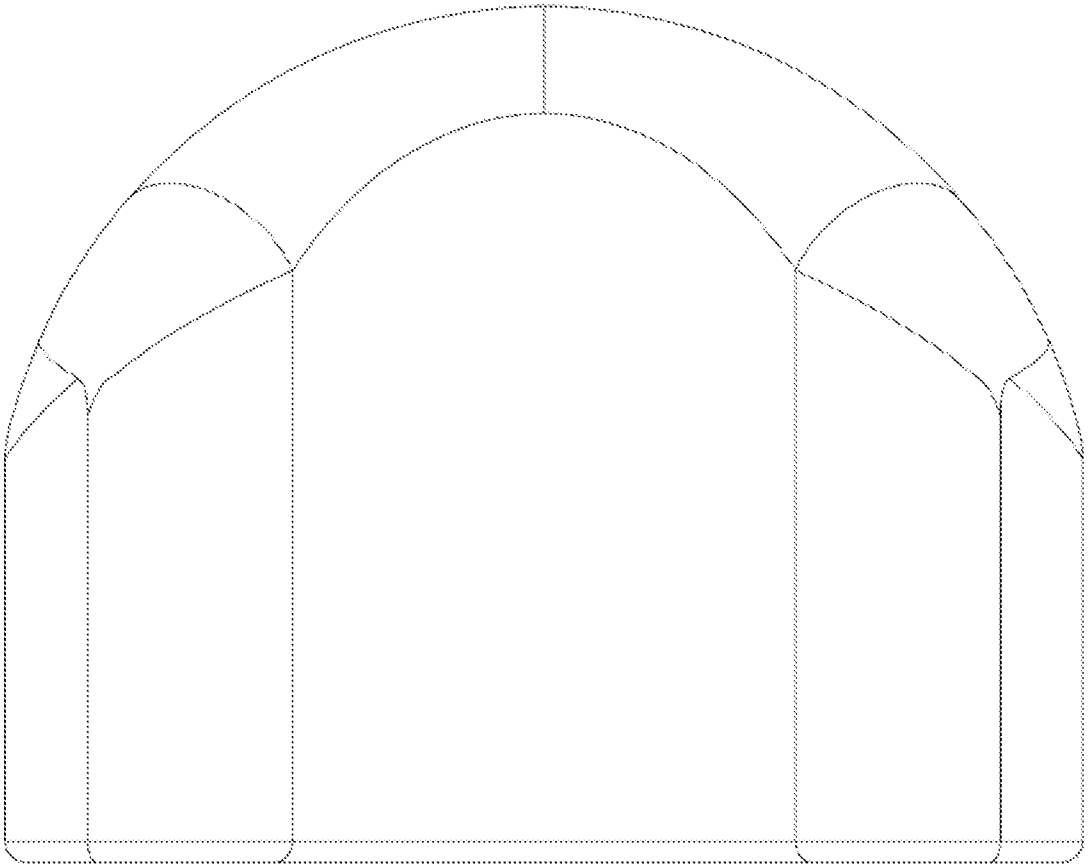
FIG. 7 is an elevational rear view of the elastically deformable body in FIG. 1.
Figure 8:
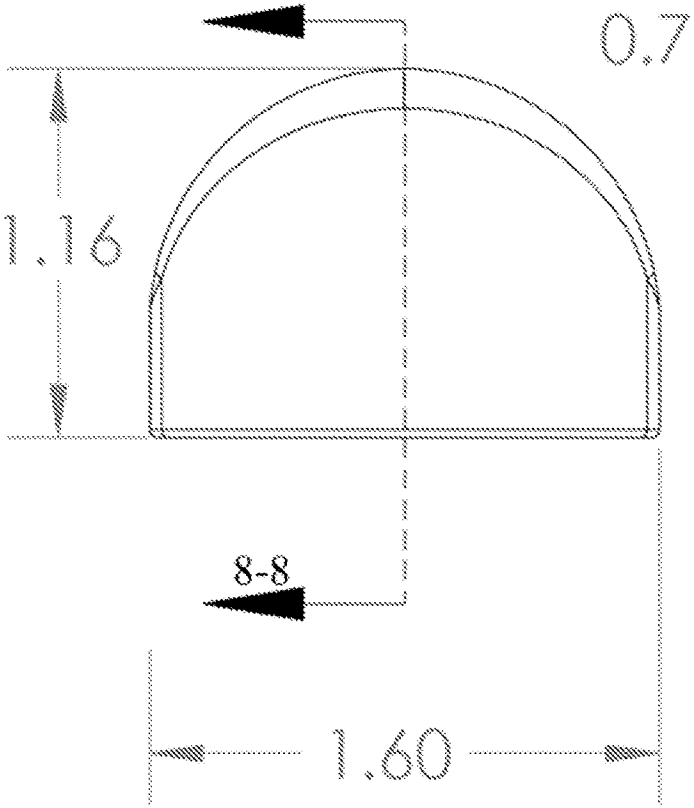
FIG. 8 is an elevational front view of an elastically deformable body with exemplary dimensions in accordance with one embodiment of the present invention.

With reference to FIG. 1, FIG. 3, and FIG. 8, the body 100 may define a body length 300 separating the first and second ends 108, 112 of the sidewall 102. Exemplary and preferred dimensions, shown in inches, are depicted in FIG. 8, wherein the body length 300 is preferably, but not necessarily, within a range of 0.25 inches to 0.55 inches to provide comfort to the user and facilitate effective use of the user's nails. The sidewall thickness may also be within a range of 0.1-1.0 inches spanning partially or entirely of the body length 300 to provide comfort to the user and facilitate effective use of the user's nails. The sidewall thickness may be uniform in some embodiments or may vary in thickness. Also looking at FIG. 1 (and FIG. 7), the sidewall 102 can also be seen having a single continuous arcuate surface spanning to and from the left and right sides of the sidewall 102.

Figure 4:
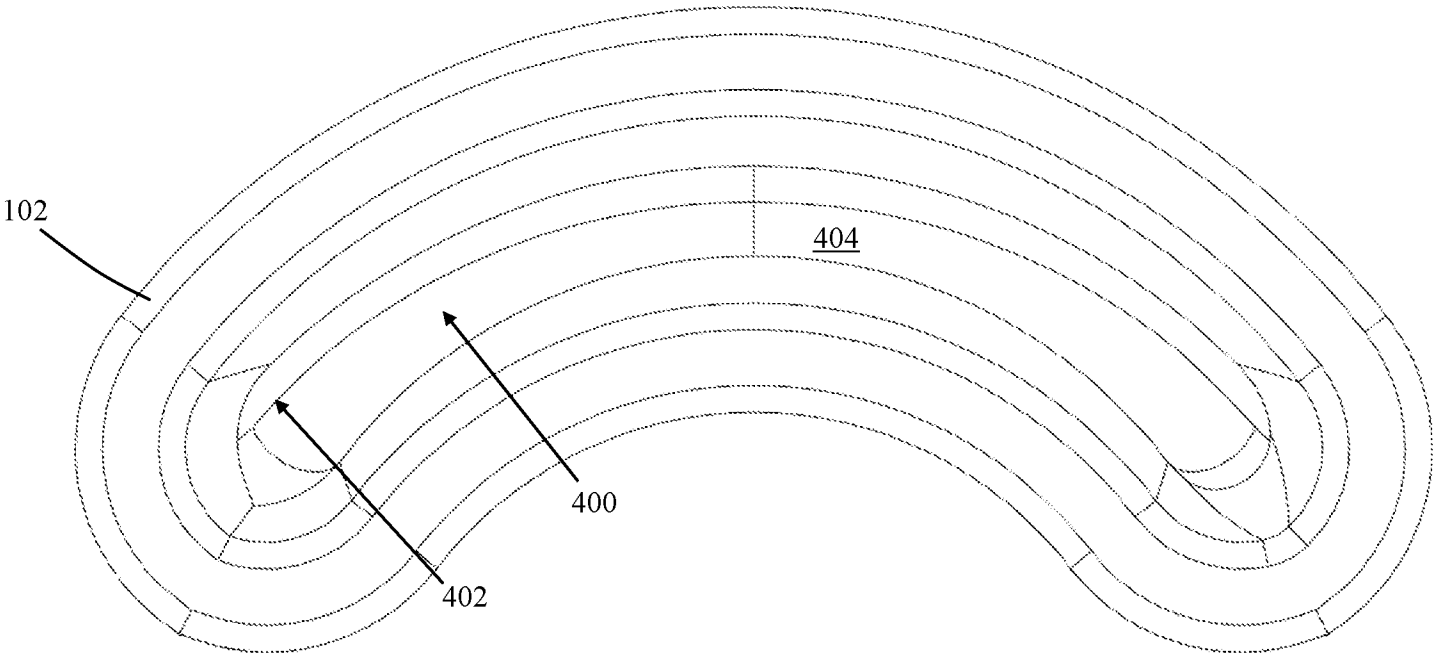
FIG. 4 is a bottom plan view of the elastically deformable body in FIG. 1.
Figure 6:
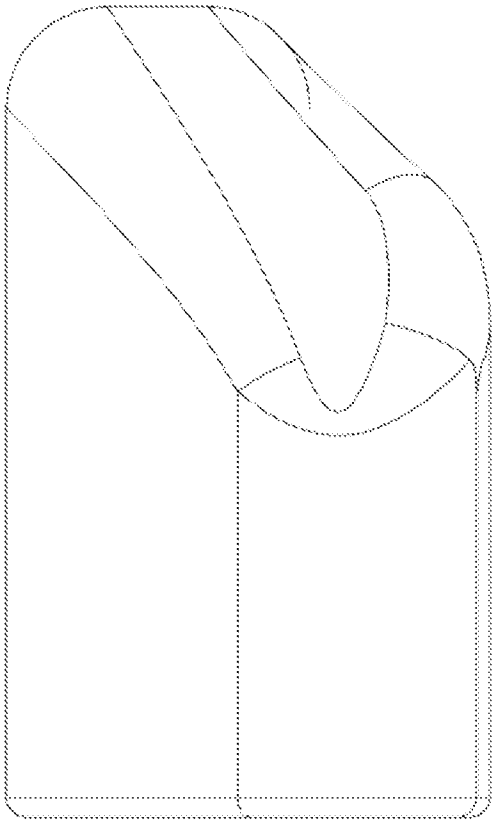
FIGS. 5-6 are elevational side views of the elastically deformable body in FIG. 1.
Figure 5:
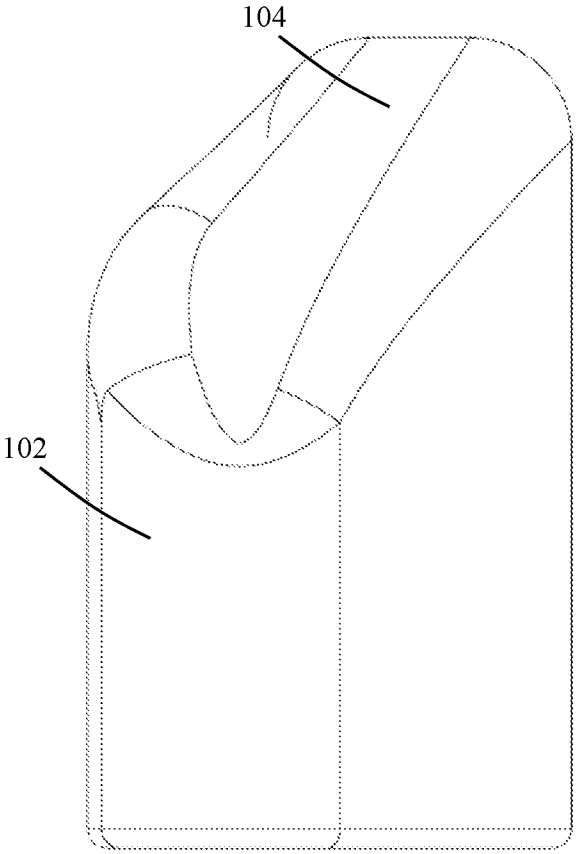

With reference to FIG. 1, FIG. 4, and FIG. 10, the inner surface 402 of the sidewall 102 that defines the nail placement cavity 404 may uniformly taper in thickness separating the inner surface 402 (on opposing sides) of the sidewall 102 from the lower aperture 400 to the upper internal wall 104 of the elastically deformable and unitary body 100. As shown best in FIG. 10, the lower aperture 400 and beginning of the nail placement cavity 404 may be approximately 0.17 mm. When desired for use, the user may insert his or her nail(s) into the nail placement cavity 404 by expanding or elastically deforming the sidewall 102, inserting his or her nail until reaching an upper internal wall 104 or surface, and releasing the sidewall 102. In some embodiments, the first end 108 of the sidewall 102 defines one or two opposing slots 1000 configured to facilitate in expanding or deforming the sidewall 102. In other embodiments, the user may insert his or her nail(s) into the nail placement cavity 404, thereby causing the body to flex and/or deform. In either method of insertion, the compression force of the sidewall 102 causes the body 100 to securely remain on the user's nail(s) when in use. The sizing of the nail placement cavity 404 and elasticity of the body 100 enable the user to preserve the integrity of his or her nail(s) without damaging any design of the nails or causing discomfort to the user. Additionally, the body 100 has been shown to preserve the design of the nails longer than normal conventional designs without the body 100 applied thereon. When not desired for use or selective removal, the user will simply reverse the order of steps to insert his or her nail(s).

The nail placement cavity 404 is enclosed by the sidewall 102 and is beneficially preformed into an arcuate shape (e.g., using manufacturing or post-manufacturing methods) to effectuate placement and use of the body 100. In other embodiments, the sidewall 102 is not preformed. The nail placement cavity 404 can be seen spanning from the lower aperture 400 and terminating at an upper internal wall 104 of the elastically deformable and unitary body 100 that is disposed proximal (e.g., at or near—within 15% of the overall length) to the second end 112 of the sidewall 102. The nail placement cavity 404 is also beneficially of a length less than 2 inches.

In one embodiment, the selectively removable and protective nail cover kit includes a set of ten elastically deformable and unitary bodies 1100*a-j* consisting of five pairs each respectively having equal body length dimensions. This is best shown in FIG. 11. At least four of the five pairs may each respectively have unique body length dimensions, e.g., there will be two bodies equally sized and designed to fit the user's thumbs, there will be two bodies equally sized and designed to fit the user's middle fingers, there will be two bodies equally sized and designed to fit the user's little fingers, and four bodies equally sized and designed to fit the user's index fingers and ring fingers (which have been shown to be substantially equal among users). In other embodiments, the kit will have two bodies equally sized and designed to fit the user's index fingers and two bodies equally sized and designed to fit the user's ring fingers.

In some embodiments, at least four of the five pairs each increase in length with respect to one another, e.g., the thumb has the greatest body length (e.g., approximately 1.16 mm), then the middle finger (e.g., approximately 1.10 mm), then the index and ring fingers (e.g., approximately 1 mm), and then the little finger (e.g., approximately 0.90 mm). In one embodiment, the unique body length dimensions of the at least four of the five pairs each respectively have a body length 300 within a range of 0.25 inches to 0.55 inches.

Although a specific order of executing the process steps has been disclosed and depicted, the order of executing the steps may be changed relative to the order shown in certain embodiments. Also, two or more steps shown in succession may be executed concurrently or with partial concurrence in some embodiments. Certain steps may also be omitted for the sake of brevity. In some embodiments, some or all of the process steps can be combined into a single process.

Moreover, various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the above described features.

What is claimed is:

1. A selectively removable and protective nail cover kit comprising:

an elastically deformable and unitary body having a sidewall with an outer surface, with a left side, with a right side opposing the left side of the unitary body, with a first end enclosing and defining a lower aperture, with a second end opposing the first end of the sidewall and having a single continuous arcuate surface spanning to and from the left and right sides of the sidewall, defining a body length separating the first and second ends of the sidewall, of a sidewall thickness within a range of 0.1-1.0 inches spanning the body length, and with an inner surface defining a nail placement cavity:

enclosed by the sidewall and preformed into an arcuate shape;

spanning from the lower aperture and terminating at an upper internal wall of the elastically deformable and unitary body that is disposed proximal to the second end of the sidewall; and of a length less than 2 inches.

2. The selectively removable and protective nail cover kit according to claim 1, wherein:

the body length is within a range of 0.25 inches to 0.55 inches.

3. The selectively removable and protective nail cover kit according to claim 1, consisting of:

a set of ten of said elastically deformable and unitary bodies consisting of five pairs each respectively having equal body length dimensions.

4. The selectively removable and protective nail cover kit according to claim 3, wherein:

at least four of the five pairs each respectively having unique body length dimensions.

5. The selectively removable and protective nail cover kit according to claim 4, wherein:

at least four of the five pairs each increase in length with respect to one another.

6. The selectively removable and protective nail cover kit according to claim 5, wherein:

the unique body length dimensions of the at least four of the five pairs each respectively have a body length within a range of 0.25 inches to 0.55 inches.

7. The selectively removable and protective nail cover kit according to claim 1, wherein:

the outer surface of the sidewall is preformed into an arcuate shape.

8. The selectively removable and protective nail cover kit according to claim 1, wherein:

the nail placement cavity tapers in thickness separating the inner surface of the sidewall from the lower aperture to the upper internal wall of the elastically deformable and unitary body.

9. The selectively removable and protective nail cover kit according to claim 1, wherein:

the nail placement cavity uniformly tapers in thickness separating the inner surface of the sidewall from the lower aperture to the upper internal wall of the elastically deformable and unitary body.

10. The selectively removable and protective nail cover kit according to claim 1, wherein:

the elastically deformable and unitary body is of a transparent material.

11. The selectively removable and protective nail cover kit according to claim 1, wherein the sidewall is formed with a front portion extending from the first end to the second end and a rear portion extending from the first end to the second end, the front and rear portions each defining a substantially planar surface spanning to and from the left and right sides of the sidewall.

12. The selectively removable and protective nail cover kit according to claim 1, wherein the first end of the sidewall defines a slot thereon to facilitate in expanding or deforming the sidewall.

13. A selectively removable and protective nail cover kit comprising:

an elastically deformable and unitary body having a sidewall with a left side, with a right side opposing the left side of the sidewall of the unitary body, with an outer surface, with a first end enclosing and defining a lower aperture, with a second end opposing the first end of the sidewall and having a single continuous arcuate surface spanning to and from the left and right sides of the sidewall, defining a body length within a range of 0.25 inches to 0.55 inches separating the first and second ends of the sidewall, and with an inner surface defining a nail placement cavity:

enclosed by the sidewall and preformed into an arcuate shape;

spanning from the lower aperture and terminating at an upper internal wall of the elastically deformable and unitary body that is disposed proximal to the second end of the sidewall; and of a length less than 2 inches.

14. The selectively removable and protective nail cover kit according to claim 13, consisting of:

a set of ten of said elastically deformable and unitary bodies consisting of five pairs each respectively having equal body length dimensions.

15. The selectively removable and protective nail cover kit according to claim 14, wherein:

at least four of the five pairs each respectively having unique body length dimensions.

16. The selectively removable and protective nail cover kit according to claim 15, wherein:

at least four of the five pairs each increase in length with respect to one another.

17. The selectively removable and protective nail cover kit according to claim 13, wherein:

the outer surface of the sidewall is preformed into an arcuate shape.

18. The selectively removable and protective nail cover kit according to claim 13, wherein:

the nail placement cavity tapers in thickness separating the inner surface of the sidewall from the lower aperture to the upper internal wall of the elastically deformable and unitary body.

19. The selectively removable and protective nail cover kit according to claim 13, wherein the first end of the sidewall defines a slot thereon to facilitate in expanding or deforming the sidewall.

20. The selectively removable and protective nail cover kit according to claim 13, wherein the sidewall is formed with a front portion extending from the first end to the second end and a rear portion extending from the first end to the second end, the front and rear portions each defining a substantially planar surface spanning to and from the left and right sides of the sidewall.

* * * * *